US007586089B2

(12) United States Patent
Hartmer

(10) Patent No.: US 7,586,089 B2
(45) Date of Patent: Sep. 8, 2009

(54) FEEDBACK FRAGMENTATION IN ION TRAP MASS SPECTROMETERS

(75) Inventor: Ralf Hartmer, Hamburg (DE)

(73) Assignee: Bruker Daltonik GmbH, Bremen (DE)

( * ) Notice: Subject to any disclaimer, the term of this patent is extended or adjusted under 35 U.S.C. 154(b) by 281 days.

(21) Appl. No.: 11/610,569

(22) Filed: Dec. 14, 2006

(65) Prior Publication Data

US 2007/0158544 A1 Jul. 12, 2007

(30) Foreign Application Priority Data

Dec. 22, 2005 (DE) ..... 10 2005 061 425

(51) Int. Cl.
*H01J 49/00* (2006.01)
*H01J 49/40* (2006.01)

(52) U.S. Cl. ..... 250/282; 250/281; 250/293; 702/19; 506/18

(58) Field of Classification Search ..... 250/281–283, 250/287, 288, 292, 293; 435/7.1; 506/18; 702/19
See application file for complete search history.

(56) References Cited

U.S. PATENT DOCUMENTS

| | | | | |
|---|---|---|---|---|
| 4,736,101 | A | 4/1988 | Syka et al. | |
| 5,171,991 | A * | 12/1992 | Johnson et al. | 250/292 |
| 5,903,003 | A * | 5/1999 | Schubert et al. | 250/282 |
| 5,936,241 | A * | 8/1999 | Franzen et al. | 250/282 |
| 6,410,913 | B1 * | 6/2002 | Brekenfeld et al. | 250/282 |
| 6,559,444 | B2 * | 5/2003 | Franzen | 250/293 |
| 6,653,622 | B2 * | 11/2003 | Franzen | 250/282 |
| 6,753,523 | B1 * | 6/2004 | Whitehouse et al. | 250/292 |
| 6,888,130 | B1 * | 5/2005 | Gonin | 250/287 |
| 6,924,478 | B1 * | 8/2005 | Zubarev et al. | 250/282 |
| 6,977,370 | B1 * | 12/2005 | Weinberger | 250/282 |
| 7,276,688 | B2 * | 10/2007 | Weiss | 250/288 |
| 7,456,397 | B2 * | 11/2008 | Hartmer et al. | 250/292 |
| 2002/0175280 | A1 * | 11/2002 | Franzen | 250/283 |
| 2003/0077616 | A1 * | 4/2003 | Lomas | 435/6 |
| 2005/0048564 | A1 * | 3/2005 | Emili et al. | 435/7.1 |
| 2005/0221500 | A1 * | 10/2005 | Reid et al. | 436/86 |
| 2006/0186331 | A1 * | 8/2006 | Hartmer et al. | 250/288 |
| 2006/0289738 | A1 * | 12/2006 | Brekenfeld | 250/282 |
| 2007/0084998 | A1 * | 4/2007 | Franzen et al. | 250/287 |
| 2007/0158544 | A1 * | 7/2007 | Hartmer | 250/282 |
| 2008/0093547 | A1 * | 4/2008 | Hartmer et al. | 250/283 |
| 2008/0135747 | A1 * | 6/2008 | Brekenfeld | 250/283 |

FOREIGN PATENT DOCUMENTS

| | | |
|---|---|---|
| EP | 0898297 A2 | 2/1999 |
| EP | 0786796 B1 | 7/2000 |
| WO | WO 99/38193 A1 | 7/1999 |

* cited by examiner

*Primary Examiner*—Bernard E Souw
(74) *Attorney, Agent, or Firm*—Law Offices of Paul E. Kudirka

(57) ABSTRACT

In an RF ion trap mass spectrometer, selected parent ions are fragmented by collisions or electrons and a spectrum of the ion fragments is measured. The measured fragment ion spectrum is then analyzed for the presence of a dominant ion species and, when a dominant ion species is present, selected parent ions are fragmented and a spectrum of the ion fragments is again measured, but with an additional collision excitation of the dominant ion species. The resulting daughter ion spectrum is qualitatively improved.

9 Claims, 2 Drawing Sheets

FEEDBACK FRAGMENTATION IN ION TRAP MASS SPECTROMETERS

BACKGROUND

The invention relates to acquisition methods for fragment ion spectra of peptides in RF ion trap mass spectrometers, which are usually coupled to separation methods such as chromatography or capillary electrophoresis.

Current mass spectrometric research into biopolymers such as peptides, proteins and genetic material is frequently coupled with fast separation methods, such as liquid chromatography (LC) or capillary electrophoresis (CE). The objective here is often to fragment the biopolymer ions in the mass spectrometer in order to obtain information about the sequences of the biopolymer building blocks and about modifications of these building blocks. For peptides and proteins this means information about the sequence of the amino acids and further information about phosphorylation, glycosylation and other changes to the original protein structure as determined by a gene. It is therefore necessary to obtain fragment ion spectra with high information content. The types of mass spectrometer for this objective have become known as "tandem mass spectrometers". The methods of acquiring fragment ion spectra with tandem mass spectrometers are often abbreviated to MS/MS or $MS^2$.

Tandem mass spectrometers comprise a first mass spectrometer to select ions of a certain type, a fragmentation device, in which these selected ions are fragmented, and a second mass spectrometer to analyze the fragment ions. In ion trap mass spectrometers, these processes of selecting, fragmenting and analyzing the fragment ions can also be performed in temporal succession within the same ion trap; this is then termed "tandem-in-time", in contrast to "tandem-in-space" in the case of spatially separated mass spectrometers.

In proteomics, it is frequently necessary to analyze thousands of peptides which have been obtained from an enzymatic digest of a complex protein mixture and separated by either liquid chromatography or electrophoresis. Qualitatively good fragment ion spectra contain information concerning the sequence of the amino acids but, unfortunately, only relatively few qualitatively good fragment ion spectra are measured with the automatic acquisition technique. This is the problem addressed by the invention described below, particularly in the light of these very complex peptide mixtures. The invention relates particularly to the use of RF ion trap mass spectrometers according to Wolfgang Paul which, on the one hand, are particularly suited to this objective but, on the other, also have characteristic drawbacks compared to other types of tandem mass spectrometer.

A Paul ion trap generally consists of a ring electrode and two end cap electrodes. An RF voltage at the ring electrode generates a quadrupole RF alternating field in the interior, which drives ions back into the center regardless of their polarity. Without collision gas, the ions oscillate in the ion trap in this so called pseudopotential well. The frequency of these so called "secular" oscillations is strongly characteristic for the charge related mass m/z of the ions. However, the ion trap is normally filled with a collision gas, usually helium, at a pressure of some $10^{-2}$ Pascal, so that the oscillation is damped in a few milliseconds by a large number of gentle collisions and the ions arrive in relative calm in the center of the ion trap, forming a small cloud. The energetic states in the interior of the molecules are also reduced; this is termed "cooling" by the collision gas. The diameter of the ion cloud in the center of the ion trap is determined by the equilibrium between the centripetal force of the RF field and the centrifugal force of the Coulomb repulsion between the ions. The ions can be excited to swinging secular oscillations by a dipolar excitation alternating voltage across both end cap electrodes, particularly when the excitation frequency matches the secular oscillation frequency. This is termed "resonant excitation".

The ions can be selectively ejected from the ion trap according to their mass by several known methods and can thus be measured in an ion detector as a mass spectrum. To acquire a fragment ion spectrum, all ion species of an ion source are first stored; the ion species which are not to be analyzed are then ejected using known methods so that only the ion species to be analyzed as "parent ions" remains in the ion trap. This process is termed "isolation" of the selected parent ions. These parent ions can now be fragmented, for example by forced collisions with the collision gas under continuous resonant excitation. The fragments which remain behind as ions can then be selectively ejected according to their mass and measured as a fragment ion spectrum. The fragment ion spectrum is also termed "daughter ion spectrum".

The filling of the ion trap with ions for subsequent isolation of the parent ions must be controlled so that sufficient numbers of ions are still available for scanning the daughter ion spectrum. One such method of control is described in the publication of the patent application DE 197 09 086 A1 (corresponding to Patents GB 2 322 961 B, U.S. Pat. No. 5,936,241 A), for example.

Besides this type of ion trap, which is usually called a "three-dimensional ion trap", there is also a "two-dimensional" or "linear" ion trap, which comprises four pole rods with end electrodes resembling apertured diaphragms. The manner of operation of this linear ion trap will not be discussed here. It must be incorporated into the basic idea of the invention, however, since the idea is not dependent on the type of ion trap, as long as this ion trap has quadrupole RF alternating fields and means for collisionally induced fragmentation.

For the stated aim of elucidating the structure of peptides, ion trap mass spectrometers are usually equipped with electrospray ion sources, which supply not only singly charged ions of the digest peptides but also doubly and triply charged ions, which are particularly suitable for fragmentation with a high information content. The conventional mode of fragmentation here is collisionally induced fragmentation (CID=collision-induced dissociation), in which the ions are forced to oscillate by means of resonant excitation within the ion trap; the ions collide with the collision gas molecules contained in the ion trap (usually helium, more rarely nitrogen), thereby absorbing energy before finally decomposing. Modern ion trap mass spectrometers are also equipped with fragmentation devices which are based on a transfer of electrons and produce a different fragmentation pattern. This fragmentation can be brought about in different ways, which are summarized here under the collective name "electron induced fragmentation" (EID=electron-induced dissociation). This fragmentation results either from the capture of low energy electrons (ECD=electron capture dissociation), from a transfer of the electrons from negatively charged ions to the positively charged analyte ions (ETD=electron transfer dissociation), or from the transfer of electrons from highly excited neutral particles (MAID=metastable atom-induced dissociation).

The two fundamentally different fragmentation methods, CID and EID, contain complementary information, and so are preferably applied to the same ion species, preferably even to ions of different charge states of this ion species.

A characteristic feature of collisionally induced fragmentation CID is that longer or heavier modifying side chains, for example phosphorylation, sulfate or glycosylation groups, are preferably split off from the chain of the amino acids as neutral fragments because, generally, they are bound with low binding energy. The fragment ion spectrum hence reflects only the naked chain of the amino acids, not their modifications. The knowledge concerning the modification is lost completely if their splitting off does not leave behind changes to the amino acids themselves. This is the case in rare cases only, such as the creation of dehydroxyserine when serine is dephosphorylated.

In the chain of the amino acids it is the peptide bonds which split during collisionally induced fragmentation CID, i.e. the bonds of the nitrogen atoms to carbon on the N-terminal side of the nitrogen. The ions thus created are termed b fragment ions if the N-terminal fragment remains as an ion charged with a proton, otherwise as a y fragment ion for the C-terminal fragment ion. If one starts with doubly charged ions, then it is frequently the case that both ions of the complementary b and y fragment ion pair occur.

In contrast, electron-induced fragmentation splits the bonds of the nitrogen atoms in the chain of the amino acids on the C-terminal side. The ions created are termed c ions or z ions. A cleavage rearrangement means that the fragmentation acts at the point where the proton which was neutralized by the electron had been attached. The fragmentation is extremely gentle; all modifications remain intact. It is favorable here to start with triply charged parent ions. The comparison of this EID fragment ion spectrum with a CID spectrum immediately shows which of the ions in the CID spectrum are of the b type and which are of the y type, since there are always fixed mass separations of 17 atomic mass units between the b ions of the CID spectrum and the c ions of the EID spectrum. Complementary to this, the y ions are always 16 atomic mass units heavier than the z ions. In addition, unusual masses for the mass separations between the ion signals in the EID spectrum immediately make it apparent which of the amino acids carries the modification and what mass this modification has. It is thus favorable to measure both the CID and the EID fragment ion spectrum for each peptide. If the time available does not allow this, then at least the EID fragment ion spectra for the modified peptide ions should be measured. Modified peptide ions can often be recognized by losses of neutral fragments of a specific mass, for example the dephosphorylation by the mass m=98 atomic mass units.

The upstream separation method for the biopolymers provides the mass spectrometer with the analyte substance, in this specific case a digest peptide, for only a few seconds. For the complex mixtures described above, several digest peptides are often supplied simultaneously at any one time; not infrequently even between ten and twenty digest peptides simultaneously. An ion trap mass spectrometer can acquire around three to five mass spectra per second, so the measurements must be carried out sparingly. The control programs of this ion trap mass spectrometer contain methods to automatically acquire fragment mass spectra; they are briefly described here:

Before a fragment ion spectrum will be measured, a continuous series of normal mass spectra are acquired. The normal mass spectra are stored digitally in the memory of the mass spectrometer. For each mass spectrum, an evaluation program is then used to determine in real time whether one or more digest peptides are in fact supplied in sufficient concentration. If this is the case, a mathematical analysis of the mass spectrum is then used to select which ion species is most favorable for the acquisition of a fragment ion spectrum. Analyses of this type are familiar to those skilled in the art; in particular, it is known how singly, doubly and triply charged ion species can be identified using the mass separations in the isotope pattern. Doubly or triply charged ions are best suited to collisionally induced fragmentation, so the most intensive ion species which occurs with a double or triple charge within a predetermined mass range, not listed in an exclusion table, is generally used for the acquisition of the next fragment ion spectrum. The exclusion table contains the mass values of those peptides which have already been analyzed in previous measuring cycles or which were marked as not of interest at the outset. The selected species of parent ion is then isolated in the ion trap and fragmented by resonant excitation in the next acquisition cycle; the fragment ions are then measured in the form of a fragment ion spectrum.

If a device for electron-induced fragmentation is present, the acquisition of an EID fragment ion spectrum most favorably begins with triply or four times charged parent ions. If time allows, it is advisable to immediately measure both the CID as well as the EID fragment ion spectra for all the ion species which occur.

For both modes of fragmentation there are method parameters which are generally set blindly by the automatic control software in the way that has, on average, proven favorable for ions of a digest peptide of this mass. This method has proven reasonably successful for peptides without modifications, but it is precisely for modified peptides that this method seems not to be sufficient. In a single liquid chromatographic separation run with automatic mass spectrometric analysis lasting several hours, a few thousand daughter ion spectra may be obtained with sufficiently high quality for a successful evaluation, which might, on the face of it, be considered a good result. However, since this run involves the acquisition of a total of 10,000 to 100,000 fragment ion spectra, the number of qualitatively good daughter ion spectra is much too low. Analyses show that the proportion of fragment ion spectra with adequate quality is frequently not more than ten percent and very rarely over 20 percent of the total number of fragment ion spectra acquired. The analytical objective of detecting all the analyte substances, if possible, has not been satisfactorily achieved as yet, a fact which, unfortunately, is all too frequently only established when these daughter ion spectra are used for an identity and structure search with the aid of "search engines" in protein sequence databases.

If one analyzes the collisionally induced fragmentation spectra more closely, it is possible to ascertain that, in particular, the modified peptides frequently do not provide good fragment spectra. In many cases, a modification group splits off from the peptide as a neutral fragment; the residual peptide is then no longer resonantly excited, but is quickly cooled in the collision gas; it can no longer decompose further under these conditions. The fragment spectrum then essentially comprises only one single dominant ion species, which still carries the same number of charges as the parent ions, but has less mass.

Peptide ions which are complexed with alkali ions are also distinguished by the occurrence of a dominant ion species in the fragment ion spectrum, but the dominant ion species carries one charge less than the selected parent ions. The alkali ion is lost here.

The spectra of electron-induced fragmentation also often exhibit only one single dominant peak, generally a radical ion which does not independently decay any further, but carries a lower charge than the parent ions.

A rough rule of thumb is that around five to fifteen percent of all fragment ion spectra exhibit such a dominant ion signal.

SUMMARY

The invention provides a method which analyzes each fragment ion spectrum in real time to see if it contains a dominant ion signal, and, when necessary, repeats the measurement on the same ion species, thereby improving the result by subjecting the ions of the dominant ion signal to an additional collisionally induced fragmentation by means of a resonant excitation. The first mode of fragmentation used can be either a collisionally induced fragmentation or an electron-induced one. The additional collisionally induced fragmentation in the repeat measurement can be generated by a method known as MS/MS/MS or $MS^3$, with the ions of the dominant ion species also being subjected to an isolation; but it is more favorable and time-saving if, during the repeat measurement following the first fragmentation, this ion species is subjected to a second fragmentation by resonant excitation without further isolation.

If there is again a dominant ion signal after the second fragmentation in the fragment ion spectrum, then the method can be repeated by fragmenting this new, dominant ion signal in order to also record the sequential splitting off of two modification groups. It is entirely possible that small numbers of triply phosphorylized peptides occur, so that a further step of this type can be useful. In general, however, these tests can be called off after the second repeat since, in this case, it is highly probable that it is not a peptide at all but an impurity.

If electron-induced fragmentation was the first mode of fragmentation used, then the repeat measurement is usually immediately successful. The dominant ion signal then stems predominantly from radical ions which are created by the electron transfer and do not immediately decompose further. Relatively minor assistance in the form of collisions caused by resonant excitation is usually sufficient here for them to decompose further. This results in spectra of the kind produced by electron-induced fragmentation, not spectra which resemble collisionally induced fragmentation.

Discretion can be exercised regarding the definition of what constitutes a "dominant ion species". It can be an ion species whose intensity is more than twice that of the next most frequent ion species; it can also be an ion species whose frequency is more than ten times greater than all the other ion species together. It is advisable to keep these conditions adjustable so that they can be adapted to the analytical objective.

BRIEF DESCRIPTION OF THE DRAWINGS

FIG. 1A illustrates the daughter ion spectrum obtained by collisionally induced fragmentation; the collisionally induced fragmentation means that the neutral loss of $H_3PO_4$ is particularly favored so that the residual peptide ion in the spectrum occurs as the dominant signal (identified with a "◆"). According to this invention, the occurrence of this dominant ion signal leads to the automatic measurement of the spectra shown in FIGS. 1B and 1C.

FIG. 1B shows a fragment spectrum obtained from a collisionally induced fragmentation of the dominant ion signal without further isolation. The fragment ion spectrum is still of only moderate quality but clearly better than the spectrum in FIG. 1A.

FIG. 1C illustrates a spectrum of the fragment ions produced by electron transfer dissociation, triggered and automatically scanned by the occurrence of the dominant ion signal in the spectrum of FIG. 1A. The quality of this ETD fragment ion spectrum is excellent and it shows the complete sequence of the amino acids as c ions, all at an intensity of 10% to 20%, with the phosphorylation of the serine being preserved.

DETAILED DESCRIPTION

While the invention has been shown and described with reference to a number of embodiments thereof, it will be recognized by those skilled in the art that various changes in form and detail may be made herein without departing from the spirit and scope of the invention as defined by the appended claims.

The invention provides a method which uses the shape of the fragment ion spectrum to estimate whether a second fragment ion spectrum of the same peptide should be acquired under extended or changed fragmentation conditions. The analysis of the fragment ion spectrum investigates if a dominant ion species occurs in this spectrum.

Figure 2:
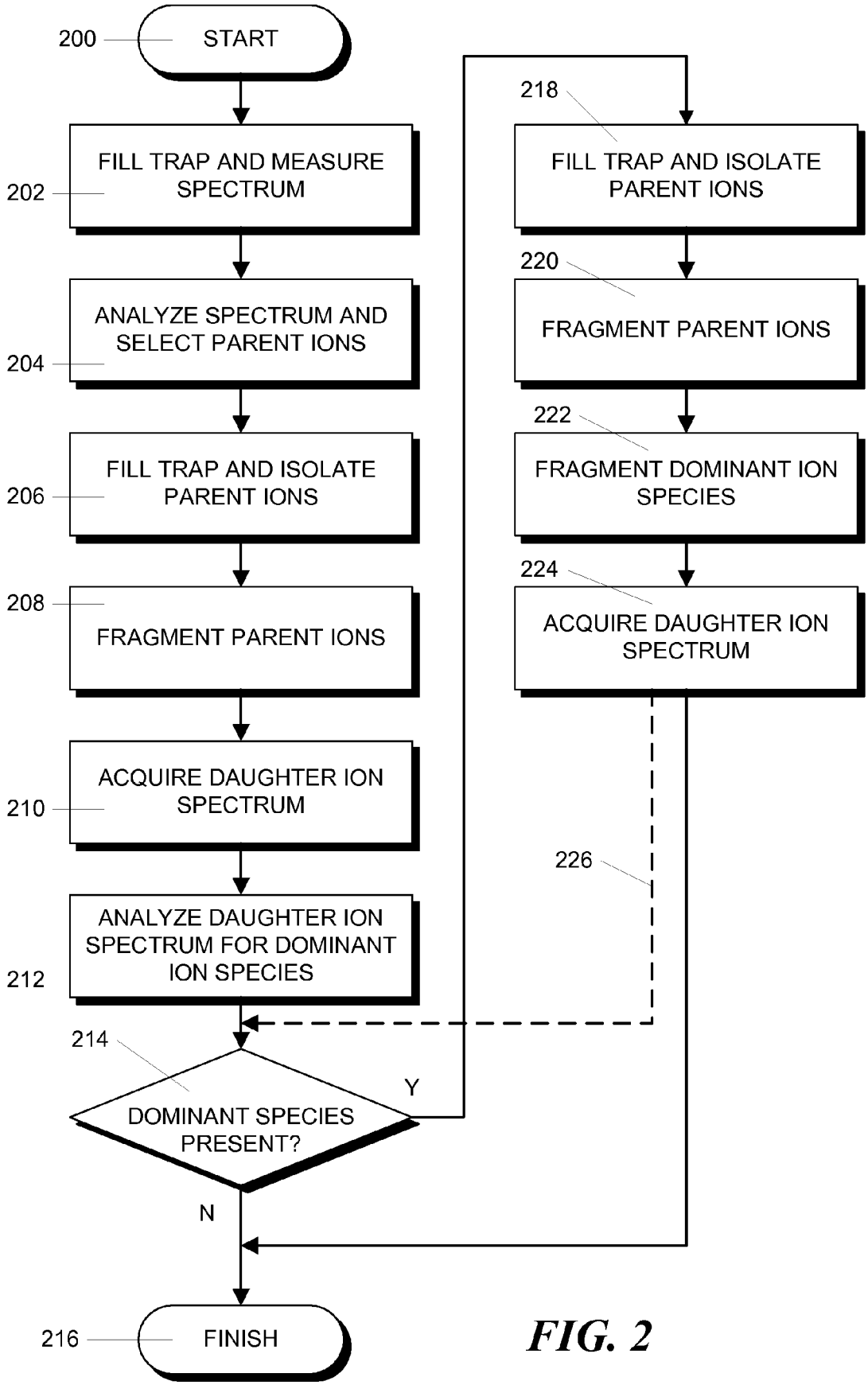
FIG. 2 is a flowchart showing the steps in an illustrative process operating in accordance with the principles of the invention.

The various embodiments of this method of acquiring daughter ion spectra of peptide ions in an ion trap mass spectrometer proceed according to the basic pattern illustrated in FIG. 2. This process begins in step 200 and proceeds to step 202 where the ion trap is filled with ions as supplied by the ion source, and a normal mass spectrum is acquired. Next, in step 204, the acquired mass spectrum, which is available in digital form in the memory of the mass spectrometer, is analyzed mathematically by a computer program, and a species of parent ion from which a daughter ion spectrum is to be measured is selected in the usual way according to predefined rules. Then, in step 206, the ion trap is again filled with ions, and the selected species of parent ion is isolated in the ion trap in the usual way by ejecting all other ion species.

In step 208, the ions of this selected species of parent ion are now fragmented in the ion trap, creating fragment ions and, in step 210 a daughter ion spectrum of the fragment ions is measured. Then, in step 212, the daughter ion spectrum, which is present in digital form in the memory of the mass spectrometer, is analyzed for the occurrence of a dominant ion species.

In step 214, a determination is made whether a dominant ion species is present. Is no dominant ion species is present, then the process ends in step 216. However, if, in step 214, it is determined that a dominant ion species is present, then the process proceeds to step 218 where the ion trap is again filled with ions, and the selected species of parent ion is isolated in the ion trap in the usual way by ejecting all other ion species. In step 220, the ions of this selected species of parent ion are now fragmented in the ion trap, creating fragment ions. In step 222, the dominant ion species is fragmented, for example, by resonant excitation and, in step 224, a daughter ion spectrum of the fragment ions is measured. The process then ends in step 216.

A first favorable embodiment of this basic pattern uses the normal collisionally induced fragmentation that is incorporated as a software-controlled process in every ion trap mass spectrometer, as the mode of fragmentation for the peptide ions in step 208. For modified peptides, this collisionally induced fragmentation frequently only produces daughter ion spectra which mainly comprise one dominant ion species with very few, usually low-intensity, additional ion species. These latter additional ion species of low intensity can often scarcely be evaluated because of poor signal-to-noise ratios. As already briefly described above, the reason for the occurrence of the dominant ion species is the loss of the modification group in the form of a neutral fragment, and the fast cooling of the residual peptide ion. The modification groups are frequently bound with lower binding energy than the bonds along the chain of amino acids, and they therefore break off very easily.

The dominant ion species thus consists here of the residual peptide ions after the modification group was lost from the parent ions. The loss of a neutral modification group can be identified by the fact that the dominant ion species carries the same number of charges per ion as the parent ions. The masses of frequently lost modification groups may corroborate such a neutral loss. If the doubly charged parent ions are selected as parent ions for a favorable collisionally induced fragmentation, then the ions of the dominant ion species present are also doubly charged. If no more modification groups are now present, a collisionally induced fragmentation of this dominant ion species will result in a daughter ion spectrum which has a high information content.

The fragmentation of an ion species from a daughter ion spectrum is generally undertaken by acquiring a granddaughter ion spectrum in a process known as MS/MS/MS. In this case, the ion trap is first filled with ions, the parent ions are then isolated and fragmented, the species of daughter ion to be analyzed further is then isolated and fragmented, and finally its fragment ions are measured as a granddaughter ion spectrum. This type of process is incorporated as standard in many ion trap mass spectrometers. This process is time-consuming, however. For the method according to the invention, on the other hand, further isolation of the dominant ion species is not necessary, so that a complete MS/MS/MS method does not have to be carried out here.

Figure 1A:
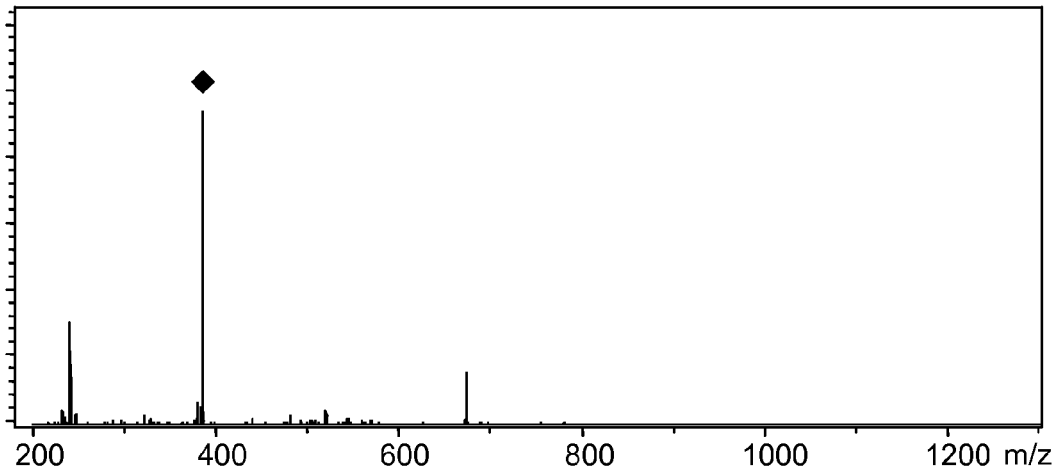
FIGS. 1A-1C illustrate three fragment ion spectra which were scanned in the automatic measurement of a triply charged modified peptide (amino acid sequence: IGRF-SEPHAR). The amino acid serine at position 5 is phosphorylated.
Figure 1B:
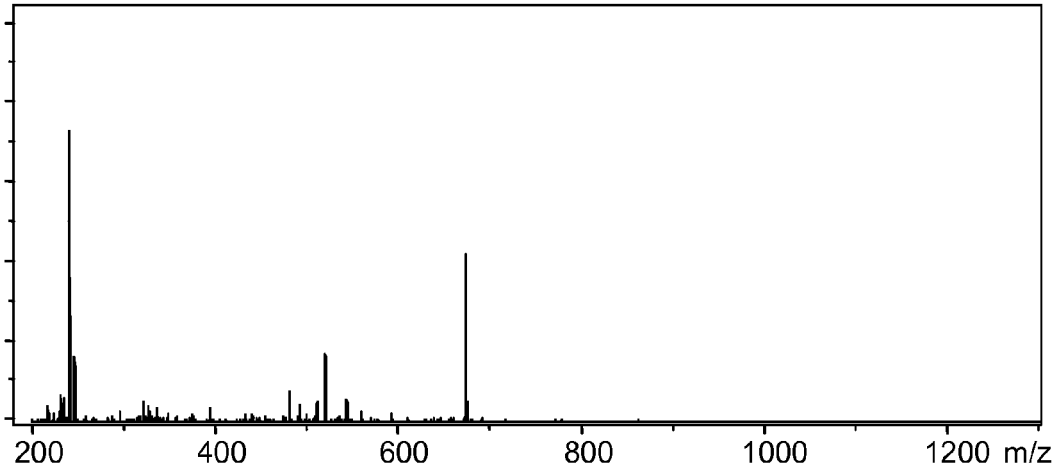
Figure 1C:
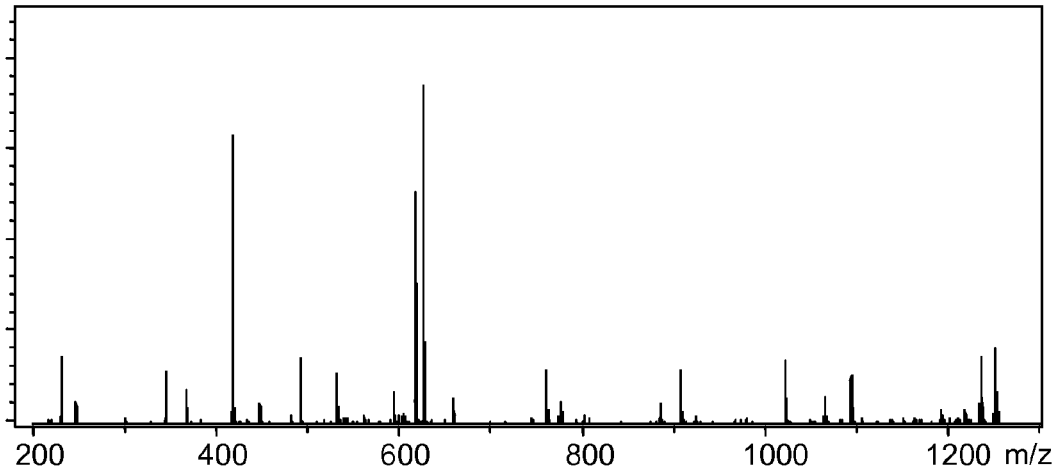

In step 218, the same species of parent ion with the same number of charges per ion, i.e. preferably doubly charged, should be selected for this purpose for the repeat measurement. After isolating and fragmenting this species of parent ion in steps 218 and 220, the dominant ion species thus created is then immediately subjected to a further collisionally induced fragmentation in step 222 without first isolating the dominant ion species. The fragmentation of these residual peptide ions can qualitatively improve the daughter ion spectrum and produce a spectrum which can be evaluated, but this improvement does not always occur to the desired extent. FIG. 1B illustrates such a fragment ion spectrum of a dominant ion species, but here the quality is still not sufficient.

Since multiply modified peptides exist, the quasi granddaughter ion spectrum created in this way can again consist of a dominant ion species. In this case, steps 214-224 of the method can be repeated as indicated by the dotted arrow 226 with further fragmentation of this now dominant ion species. The masses of the neutral losses may indicate whether it is worthwhile to continue with this process.

For this method of a collisionally induced fragmentation in steps 208 and 220 and the splitting off of a neutral fragment, the definition of what constitutes a dominant ion species should not be too narrow. The occurrence of one ion species which is more than five times as frequent as the next most intensive ion species already justifies this method, since generally the daughter ion spectrum is improved.

The analysis of the daughter ion spectrum may also show that a dominant ion species is indeed present, but carries one charge per ion less than the parent ions. What occurs here is the splitting off of an easily removed cation. This loss of a cation generally occurs when the peptide ion is complexed with an alkali ion. Frequently the ions which split off are sodium ions (23 atomic mass units), potassium ions (39 mass units) or ammonium ions (18 mass units); but more complex cations also get lost. In this case, the species of parent ion selected at step 218 for the repeat measurement should, if possible, carry one charge per ion more than the previously measured species of parent ion selected in step 204 so that the second fragmentation is carried out on a multiply charged ion species.

A second favorable embodiment of the method requires an ion trap mass spectrometer which is equipped with a device for electron-induced fragmentation. This device can contain an ion source to generate negative reactant ions which, after isolation of the parent ions, are filled into the ion trap, where they react with the positively charged parent ions, giving up electrons to form fragment ions. Alternatively, the device can contain a source for highly excited neutral atoms, for example a fast atom bombardment source (FAB), which supplies highly excited, but well-focused, helium atoms, with which the isolated parent ions can be bombarded in the ion trap, triggering electron-induced fragmentation (MAID) by transfer of an electron.

In ion trap mass spectrometers with a device for EID fragmentation it is advisable to always measure CID fragment ions and EID fragment ions alternately. The reasons for this are described above. Sometimes, however, time constraints do not allow such a time-consuming measurement series to be performed. Then, as defined in this invention, it is advisable to always measure an EID fragment ion spectrum at the exact point when the CID fragment ion spectrum exhibited a dominant ion signal. It is then highly probable that a modification is present, whose identity and localization is indicated by the EID fragment ion spectrum.

With electron-induced fragmentation, too, it is frequently observed that daughter ion spectra are generated which essentially consist of a single dominant ion species with its isotope peaks. The occurrence does not depend on whether the EID fragment ion spectra were triggered by dominant ion species or were obtained by alternate scanning with both modes of fragmentation. Predominantly, in these cases the transfer of the electron does not immediately lead to a rearrangement cleavage of the peptide chain but to the formation of a peptide ion radical which contains the proton in addition to the accepted electron. The mass m of these ions corresponds precisely to the parent ion, but they have one charge less and hence a different m/z. These radical ions decompose relatively easily, and therefore the repeat measurement requires only a weak resonant excitation. This makes it possible to fractionate it at a low RF voltage, whereby even very small fragment ions can still be held in the ion trap.

The controls of the measurement procedures in the ion trap which are necessary for this method are familiar to those skilled in the art. They are implemented in the control software for the ion trap mass spectrometer.

Modern types of liquid chromatography, including nano-LC, provide the directly coupled mass spectrometer with each of the separated peptides for around five to twenty seconds. An analyte substance is therefore available for measuring for several seconds. Modern ion trap mass spectrometers, which can acquire several fragment ion spectra per second, are therefore able to remeasure fragment ion spectra which are promising but not good enough. Such mass spectrometers, which have both collisionally induced as well as electron-induced fragmentation available to them, are then able to mathematically analyze the daughter ion spectra at precisely the time when the other mode of fragmentation is being applied to the parent ions. This means that practically unlimited time is available for a careful evaluation. But even without this option of alternate measurements, not much time is lost because fast algorithms are quite capable of analyzing the daughter ion spectra in a few milliseconds (or even in less than a millisecond) for the occurrence of dominant ion species and of determining their charge state.

However, the separation method does not necessarily have to be coupled directly with the mass spectrometry, in order to benefit from the present invention. A measurement procedure which is being used more and more frequently is the non-direct coupling of liquid chromatography with a mass spectrometer which ionizes solid samples on a sample support with matrix-assisted laser desorption ("LC MALDI"). Here the eluate from the liquid chromatograph is put, in the form of many individual droplets, onto previously prepared sample supports, which can accommodate hundreds or even thousands of samples. The sample droplets are dried and then fed to the mass spectrometer. However, the invention presented here can only be used properly for LC-MALDI if multiply charged ions are successfully generated which are more favorable for a fragmentation than singly charged ones.

With knowledge of this invention, specialists in this field will be able to make further modifications to the measurement procedures. In particular they will be able to specify further suitable conditions for the decision as to when a dominant ion species is present.

What is claimed is:

1. A method for acquiring an improved daughter ion spectra of ions of peptides in an ion trap mass spectrometer, comprising:

(a) filling the ion trap with ions and acquiring a mass spectrum of the ions;

(b) analyzing the mass spectrum acquired in step (a) and, based on the results of the analysis, selecting a species of parent ion from which a daughter ion spectrum is to be measured;

(c) filling the ion trap with ions and isolating the selected species of parent ion;

(d) fragmenting the ions of the selected species of parent ion isolated in step (c);

(e) acquiring a daughter ion spectrum of ion fragments resulting from step (d);

(f) analyzing the daughter ion spectrum for the presence of a dominant daughter ion species; and (g) when a dominant daughter ion species is present, (g1) filling the ion trap with ions and isolating the selected species of parent ion;

(g2) fragmenting the ions of the selected species of parent ion isolated in step (g1);

(g3) resonantly exciting the dominant daughter ion species; and (g4) acquiring the improved daughter ion spectrum of ion fragments resulting from steps (g2) and (g3).

2. The method of claim 1, wherein steps (d) and (g2) comprise fragmenting the ions of the selected species of parent ion by collisionally induced fragmentation.

3. The method of claim 2, wherein step (f) further comprises, when a dominant ion species is present, determining the charge state of the dominant ion species, and wherein step (g1) comprises:

(g1a) when the charge state of the dominant ion species matches the charge state of the selected species of parent ion isolated in step (c), isolating that species of parent ion; and (g1b) when the charge state of the dominant ion species is lower than the charge state of the selected species of parent ion isolated in step (c) isolating a species of parent ion with a charge state higher than the charge state of the selected species of parent ion isolated in step (c).

4. The method of claim 1, wherein step (b) comprises selecting a multiply-charged species of parent ion and step (d) comprises fragmenting the ions of the selected species of parent ion by electron-induced fragmentation.

5. The method of claim 1, wherein step (d) comprises fragmenting the ions of the selected species of parent ion by alternate applications of collisionally induced and electron-induced fragmentation.

6. The method of claim 1, wherein step (b) comprises selecting a species of parent ion according to fixed rules.

7. The method of claim 1 wherein step (f) comprises determining the presence of a dominant ion species according to fixed rules.

8. The method of claim 1, wherein the peptides are separated by one of a liquid chromatography separation unit and a capillary electrophoresis separation unit and wherein the method further comprises directly coupling the ion trap mass spectrometer with the one separation unit, acquiring the daughter ion spectra by proceeding automatically with steps (a)-(g), and analyzing the spectra in step (f) in real time.

9. A method for acquiring an improved daughter ion spectrum of ions of peptides in an ion trap mass spectrometer, comprising:

(a) filling the ion trap with ions and acquiring a mass spectrum of the ions;

(b) analyzing the mass spectrum acquired in step (a) and, based on the results of the analysis, selecting a species of parent ion from which a daughter ion spectrum is to be measured;

(c) filling the ion trap with ions and isolating the selected species of parent ion;

(d) fragmenting the ions of the selected species of parent ion isolated in step (c) by collisionally induced fragmentation;

(e) acquiring a daughter ion spectrum of ion fragments resulting from step (d);

(f) analyzing the daughter ion spectrum for the presence of a dominant daughter ion species; and (g) when a dominant daughter ion species is present, (g1) filling the ion trap with ions and isolating the selected species of parent ion;

(g2) fragmenting the ions of the selected species of parent ion isolated in step (g1) by electron induced dissociation; and (g3) acquiring the improved daughter ion spectrum of ion fragments resulting from step (g2).

* * * * *